US006327848B1

(12) United States Patent
Poggio et al.

(10) Patent No.: US 6,327,848 B1
(45) Date of Patent: Dec. 11, 2001

(54) SELF-ADAPTING CONTROL METHOD FOR AN EXHAUST SYSTEM FOR INTERNAL COMBUSTION ENGINES WITH CONTROLLED IGNITION

(75) Inventors: Luca Poggio, Spinetta; Daniele Ceccarini, Rimini; Matteo De Cesare, Torremaggiore; Ciro Barberio, Zola Predosa; Alessandro Verdecchia, Bologna, all of (IT)

(73) Assignee: Magneti Marelli S.p.A, Milan (IT)

( * ) Notice: Subject to any disclaimer, the term of this patent is extended or adjusted under 35 U.S.C. 154(b) by 0 days.

(21) Appl. No.: 09/657,150

(22) Filed: Sep. 7, 2000

(30) Foreign Application Priority Data

Sep. 7, 1999 (IT) ..... BO99A0478

(51) Int. Cl.[7] ..... F01N 3/00

(52) U.S. Cl. ..... 60/276; 60/274; 60/277; 60/295; 60/301

(58) Field of Search ..... 60/276, 277, 295, 60/301, 274

(56) References Cited

U.S. PATENT DOCUMENTS

| | | | | |
|---|---|---|---|---|
| 5,402,641 | * | 4/1995 | Katoh et al. | 60/277 |
| 5,724,808 | * | 3/1998 | Ito et al. | 60/277 |
| 5,743,084 | | 4/1998 | Hepburn . | |
| 5,771,685 | | 6/1998 | Hepburn . | |
| 6,105,365 | * | 8/2000 | Deeba et al. | 60/274 |
| 6,128,899 | * | 10/2000 | Oono et al. | 60/285 |
| 6,161,377 | * | 12/2000 | Boegner et al. | 60/285 |
| 6,199,372 | * | 3/2001 | Wakamoto | 60/277 |
| 6,205,773 | * | 3/2001 | Suzuki | 60/276 |
| 6,237,330 | * | 5/2001 | Takahashi et al. | 60/285 |
| 6,244,046 | * | 6/2001 | Yamashita | 60/277 |

FOREIGN PATENT DOCUMENTS

| | | |
|---|---|---|
| 0690213 | 1/1996 | (EP) . |
| 0878610 | 11/1998 | (EP) . |
| 0892159 | 1/1999 | (EP) . |
| 0899430 | 3/1999 | (EP) . |
| 0950803 | 10/1999 | (EP) . |

* cited by examiner

*Primary Examiner*—Thomas Denion
*Assistant Examiner*—Diem Tran
(74) *Attorney, Agent, or Firm*—Jacobson Holman, PLLC

(57) ABSTRACT

A self-adapting control method for an exhaust system for internal combustion engines with controlled ignition, including an engine, a pre-catalyst, a trap for the collection of nitrogen oxides having a maximum initial capacity and a maximum available capacity not greater than this maximum initial capacity and a linear oxygen sensor disposed downstream of the trap for the collection of nitrogen oxides and generating at least a downstream composition signal substantially proportional to a downstream oxygen titer. The method comprises the stages of carrying out at least one regeneration process and carrying out at least one desulphurisation process of the trap for the collection of nitrogen oxides and also the stage of estimating, at least after each regeneration process, the maximum available capacity as a function of the maximum initial capacity and the downstream composition signal.

19 Claims, 7 Drawing Sheets

START
100
CALCULATE NOx_ST AND NOx_EFF
105
NOx_EFF > NOx_EFF*
YES
NO
110
REQUEST REGENERATION
RRQ= TRUE
120
NOx_ST<NOx_ST*
NO
YES
130
DOWNSTREAM TITRE RICH?
NO
YES
155
CALCULATE NOx_ST
140
τ_N > τ_DN
NO
YES
150
REQUEST DISCONTINUATION?
NO
YES
160
DISCONTINUE REGENERATION
170
STOP

START
300
REGENERATION UNDERWAY ?
NO
YES
CALCULATE $CO_V$
310
CALCULATE $CO_{V1}$
320
330
$CO_{VTOT} > CO_{TH}$
YES
NO
CALCULATE $K_{AGN}$
340
CALCULATE $C_{MD}$
345
DISCONTINUE REGENERATION
350
STOP
360

SELF-ADAPTING CONTROL METHOD FOR AN EXHAUST SYSTEM FOR INTERNAL COMBUSTION ENGINES WITH CONTROLLED IGNITION

The present invention relates to a self-adapting control method for an exhaust system for internal combustion engines with controlled ignition.

BACKGROUND OF THE INVENTION

It is known that the composition of the exhaust gases produced in controlled ignition engines (for instance in petrol or gas engines in which the combustion of the air/fuel mixture is triggered, following command by the control system of the engine, by the ignition of a spark at a predetermined moment), depends, among other things, on the composition of the air/fuel mixture that is injected into the cylinders. These engines can in particular operate using a lean fuel mixture, i.e. having a ratio (A/F) greater than the stoichiometric ratio $(A/F)_{ST}$, or, in an equivalent manner, having a titre $\lambda$, defined by the ratio $(A/F)/(A/F)_{ST}$, greater than 1. In these circumstances, the exhaust gases form a highly oxidising atmosphere as a result of which a normal three-way catalyst (TWC) is not sufficient to remove the nitrogen oxide component NOx produced during combustion. As shown in FIG. 1, the efficiency of removal of nitrogen oxides $\eta_{NOx}$ for a normal three-way catalyst is very high and close to 1 when the engine operates with a rich air/fuel mixture (having a ratio (A/F) lower than the stoichiometric ratio $(A/F)_{ST}$ or, in an equivalent manner, a titre $\lambda$ lower than 1), but deteriorates rapidly for values of the ratio (A/F) that are greater than the stoichiometric ratio $(A/F)_{ST}$. Vice versa, the efficiency of removal of carbon monoxide $\eta_{co}$, and, respectively, of non-combusted hydrocarbons $\eta_{HC}$ is low in the presence of a rich air/fuel mixture and close to 1 for a lean air/fuel mixture.

A solution that is commonly used is to dispose, downstream of a three-way pre-catalyst, a main catalyst formed by a trap able to absorb and store the nitrogen oxides (a so-called NOx TRAP). When the trap is saturated, however, it is no longer able to perform this function and must therefore be emptied by means of a regeneration process which consists in creating, within the trap, an atmosphere such as to give rise to reduction reactions of the nitrogen oxides NOx. Molecular nitrogen $N_2$, steam and other non-polluting products are released during these reactions. The reducing atmosphere is obtained by causing a mixture of exhaust gases composed chiefly of carbon monoxide CO and non-combusted hydrocarbons HC and substantially free from nitrogen oxides NOx to flow into the trap, as is the case when the engine operates with a rich air/fuel mixture. In this case, there is an overproduction of carbon monoxide CO and non-combusted hydrocarbons HC that the three-way catalyst is not able to remove as a result of the fact that it is not very efficient in the presence of a rich mixture, while the emissions of nitrogen oxides NOx are drastically reduced. The exhaust gas mixture thus produced reacts with the nitrogen oxides NOx present in the trap, thereby emptying it. During the regeneration process, moreover, the titre downstream of the trap is substantially stoichiometric.

The use of traps of the type described above raises a further problem connected with the fact that they also store sulphur oxides SOx. Even though the capture of sulphur oxides SOx is a slower process than the capture of nitrogen oxides NOx, provision must nevertheless also be made for desulphurisation cycles in order to maximise the available capacity and the efficiency of the trap.

Moreover, in order to ensure that the trap is highly efficient and to limit the consumption of fuel and polluting emissions, these regenerations and desulphurisations must be carried out according to well defined strategies.

The control systems available at present are based on units provided with a first oxygen sensor (LAMBDA sensor of linear type) disposed upstream of the catalyst TWC and a second oxygen sensor (LAMBDA sensor of on/off type) disposed downstream of the trap. The regeneration strategies currently used estimate the degree of filling of the trap solely from mapping of the engine and from physical and mathematical models, to whose parameters predetermined values are assigned at the calibration stage. The efficiency of control depends, among other things, on the accuracy of these values which cannot, however, subsequently be automatically updated during the operation of the system.

The systems described above are disadvantageous as they are not able to take account of any deviations with respect to nominal operating conditions. In particular, the performances of the various components are not constant over time, but show drifts due, for instance, to ageing or to the onset of malfunctions, as a result of which the values of the parameters of the physical and mathematical models set during calibration are not longer adapted correctly to describe the state of the system. In these circumstances, therefore, conventional regeneration strategies do not guarantee that measures to reset the efficiency of the trap are carried out when they are actually necessary. Consequently, it may be case that the trap remains saturated for longer than it should before it is emptied, with a substantial increase in polluting emissions from the vehicle. Moreover, the duration of the regenerations is also predetermined and cannot be modified if it proves to be inadequate.

SUMMARY OF THE INVENTION

The object of the present invention is to provide a self-adapting control method which is free from the drawbacks described above and which is, in particular, able to carry out a regeneration strategy on the basis of an estimation of the real conditions of the system.

The present invention therefore relates to a self-adapting control method for an exhaust system for internal combustion engines with controlled ignition, this exhaust system comprising an engine, a pre-catalyst, means for capturing nitrogen oxides having a maximum initial capacity and a maximum available capacity not greater than this maximum initial capacity, oxygen sensor means disposed downstream of the means for capturing nitrogen oxides and generating at least one downstream composition signal, this method comprising the stages of:

a) carrying out at least one process of regeneration of the means for capturing nitrogen oxides, b) carrying out at least one process of desulphurisation of the means for capturing nitrogen oxides, characterised in that it further comprises the stage of:

c) estimating, at least after each such process of regeneration of the means for capturing nitrogen oxides, the maximum available capacity as a function of the maximum initial capacity and the downstream composition signal, and in that the downstream composition signal is substantially proportional to a downstream oxygen titre.

BRIEF DESCRIPTION OF THE DRAWINGS

The invention is described in further detail below with reference to a preferred embodiment thereof, given purely by way of non-limiting example, made with reference to the accompanying drawings, in which.

DETAILED DESCRIPTION OF THE INVENTION

Figure 1:
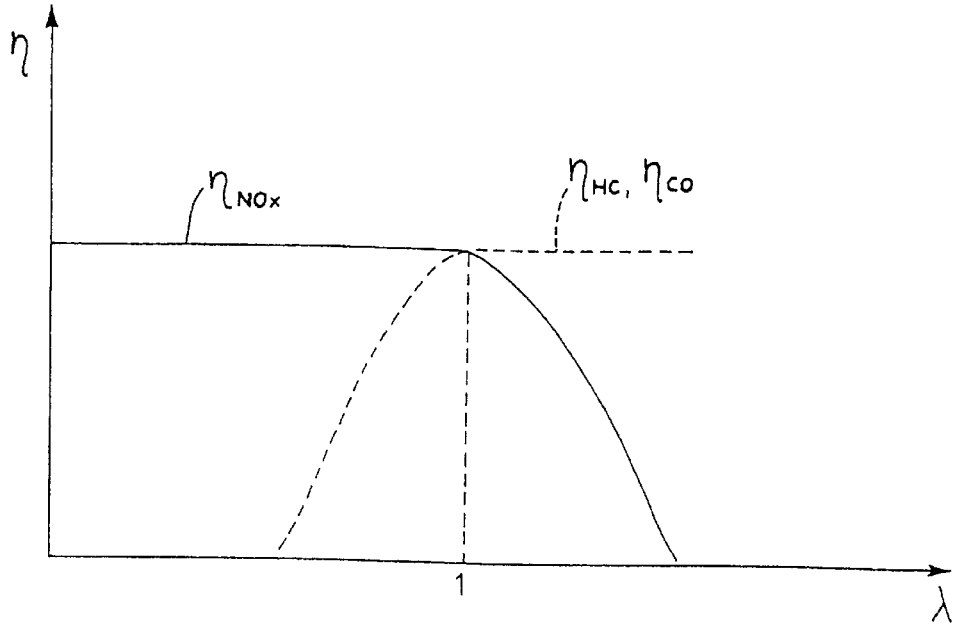
FIG. 1 shows efficiency curves in a three-way catalyst.

In FIG. 1, a control system for the exhaust of an internal combustion engine 2 with controlled ignition is shown overall by 1. The engine 2 is connected, via a first exhaust duct section 3*a,* to a pre-catalyst 4, for instance a catalyst TWC. A second exhaust duct section 3*b* connects an output of the pre-catalyst 4 to an input of a trap 5 for the collection of nitrogen oxides NOx. The trap 5 is in particular composed of cells adapted to absorb and store molecules of nitrogen oxides NOx.

A first sensor of the concentration of oxygen in the exhaust gases, hereafter referred to as the upstream sensor 6, and a second sensor of the concentration of oxygen in the exhaust gases, hereafter referred to as the downstream sensor 7, are disposed upstream of the pre-catalyst 4 and, respectively along a third duct section 3*c* downstream of the trap 5. Advantageously, both the oxygen concentration sensors are sensors of the linear LAMBDA or UEGO type. The sensors 6 and 7 generate an upstream composition signal $V_1$, representative of an upstream titre $\lambda_M$ at the output from the engine 2 and, respectively, a downstream composition signal $V_2$, representative of a downstream titre $\lambda_V$ at the output from the trap 5.

A temperature sensor A is disposed along the second exhaust duct section 3*b* and generates a temperature signal $V_T$.

The control system 1 further comprises a control unit 10 which receives as input the upstream and downstream composition signals $V_1$ and $V_2$ and the temperature signal $V_T$ as well as a plurality of engine-related parameters which are not shown for the sake of simplicity, and supplies as output a plurality of operating quantities for respective engine control variables calculated in a known manner and not shown.

Figure 2:
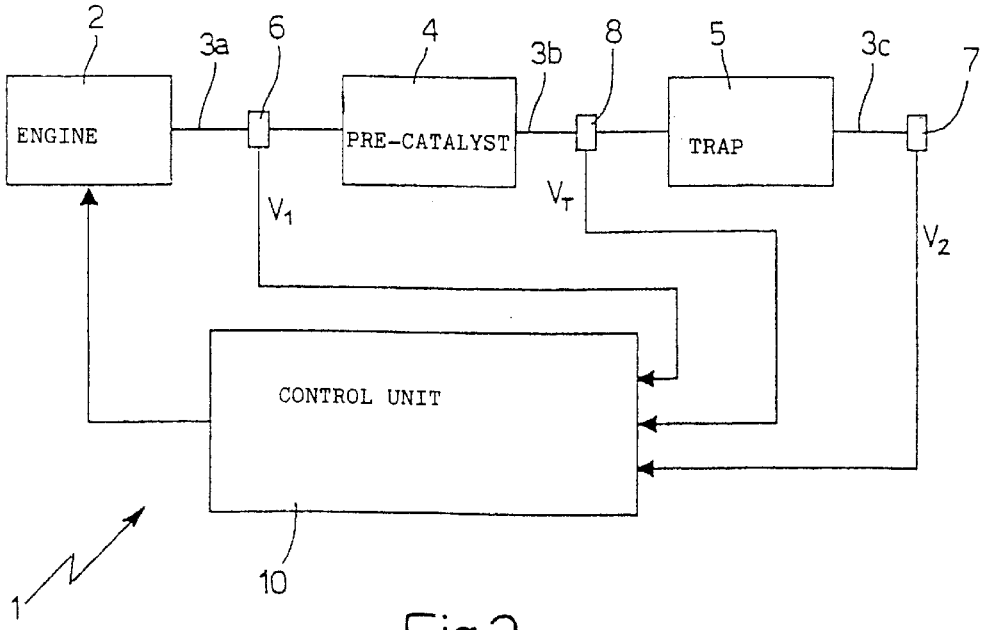
FIG. 2 is a simplified block diagram of a control system of the present invention.
Figure 3:
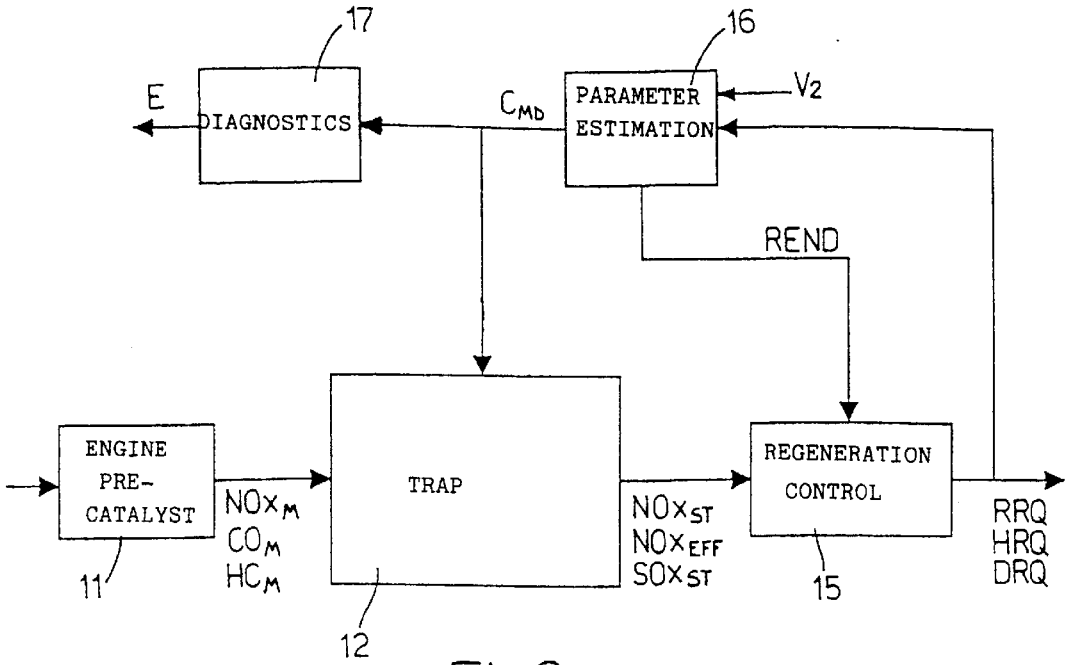
FIG. 3 is a more detailed block diagram relating to a part of the system of FIG. 2.

A block diagram relating to the control unit 10 is shown in greater detail in FIG. 2.

An engine/pre-catalyst block 11 receives as input the downstream composition signal $V_1$ and a plurality of engine-related parameters and supplies as output an estimate of the composition of the exhaust gases at the output of the pre-catalyst 4. In particular, three quantities relating to the exhaust gases being output from the pre-catalyst 4 are calculated: an upstream quantity of nitrogen oxides $NOx_M$, an upstream quantity of carbon monoxide $CO_M$ and an upstream quantity of non-combusted hydrocarbons $HC_M$. These quantities take account of the efficiency of the pre-catalyst 4 in the respective removal of nitrogen oxides $\eta_{NOx}$, carbon monoxide $\eta_{CO}$ and non-combusted hydrocarbons $\eta_{HC}$ as a function of the upstream titre $\eta_M$ according to the curves shown in FIG. 1.

The upstream quantities of nitrogen oxides $NOx_M$, carbon monoxide $CO_M$ and non-combusted hydrocarbons $HC_M$ are supplied as input to a trap block 12 which also receives an estimate of the maximum capacity $C_{MD}$, as will be explained below, the temperature signal $V_T$ and a fuel flow value F. The trap block 12 which, as will be described in detail below, contains a model of the processes of capture of nitrogen oxides and sulphur by the trap 5, calculates and supplies as output a capture efficiency $NOx_{EFF}$, a quantity of nitrogen oxides stored $NOx_{ST}$, a quantity of nitrogen oxides exchanged $NOx_{CAP}$ and a quantity of sulphur oxides stored $SOx_{ST}$.

The outputs from the trap block 12 are supplied as input to a regeneration control block 15, which implements a regeneration control procedure and a desulphurisation control procedure, described in detail below, to check for the conditions that make it necessary to carry out a regeneration and/or a desulphurisation. The regeneration control block 15 also generates a plurality of signals that are supplied to a system supervisor, not shown for the sake of simplicity. In particular, the regeneration block 15 supplies a regeneration request signal RRQ, a desulphurisation request signal DRQ and a heating request signal HRQ. These signals are of a logic type and can therefore assume a logic value "TRUE" or a logic value "FALSE".

The regeneration request signal RRQ is supplied as input to a parameter estimation block 16 which also receives the downstream composition signal $V_2$ and, as will be explained in detail below, implements an algorithm updating certain parameters of the models contained in the trap block 12. In particular, the parameter estimation block 16, when necessary, estimates the maximum available capacity $C_{MD}$ and supplies it as input to the trap block 12 and to a diagnostic block 17. Moreover, the parameter estimation block 16 generates a regeneration discontinuation signal REND, of logic type, that is supplied as input to the regeneration control block 15.

Figure 4:
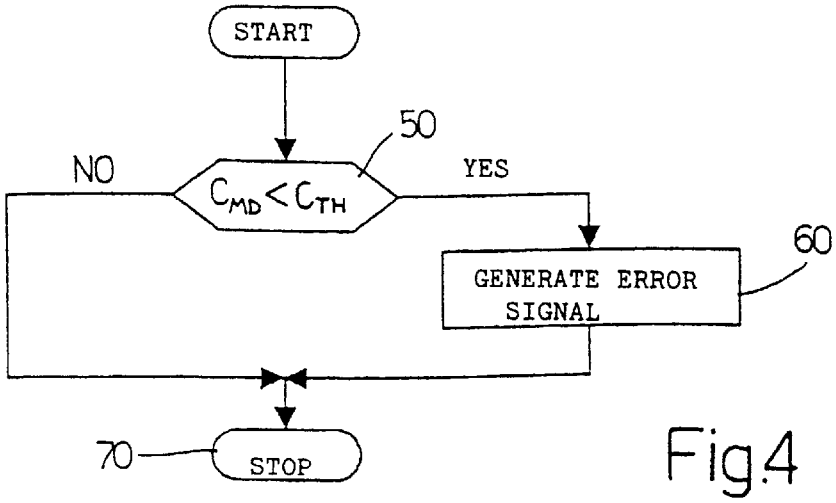
FIGS. 4 to 7 are flow diagrams of the control method of the present invention.

With reference to FIG. 4, the diagnostic block 17 checks the state of ageing of the trap 5, comparing the maximum available capacity $C_{MD}$ with a threshold capacity $C_{TH}$ (block 50). If the maximum available capacity $C_{MD}$ is lower (output YES from the block 50), the diagnostic block 17 generates as output an error signal E (block 60), of logic type, setting it to the logic value "TRUE" in order to indicate a malfunction.

In detail, the calculation of the capture efficiency $NOx_{EFF}$ and of the quantity of nitrogen oxides stored $NOx_{ST}$ carried out in the trap block 12, is based on an estimate of a residual capacity $C_R$ of the trap 5 and on the upstream quantities of nitrogen oxides $NOx_M$, carbon monoxide $CO_M$ and non-combusted hydrocarbons $HC_M$ calculated by the engine/pre-catalyst block 11. The residual capacity $C_R$ is deduced from the following equations:

$$C_{MD}=K_{AG}\,C_M \tag{1}$$

$$C_L=C_{MD}-SOx_{ST} \tag{2}$$

$$C_R=C_D-NOx_{ST} \tag{3}$$

in which $C_M$ is the maximum capacity of the trap 5, $C_{MD}$ is the maximum available capacity and $C_L$ is the free capacity. In particular, the maximum capacity $C_M$ and the maximum available capacity $C_{MD}$ represent the maximum quantities of nitrogen oxides NOx that the trap 5 can store at the beginning of its life and, respectively, at the current moment, while the free capacity $C_L$ is that part of the maximum available capacity $C_{MD}$ not occupied by sulphur oxides SOx. The maximum available capacity $C_{MD}$ is not greater than the maximum capacity $C_M$ as, at a given moment, a proportion of the cells making up the trap 5 is not able to capture molecules of nitrogen oxides NOx, for two main reasons. Firstly, some cells are irreversibly damaged, as a result of ageing, for instance because they are obstructed by solid deposits. The coefficient of ageing $K_{AG}$ which appears in equation (1) and is updated by an adaptation algorithm described in detail below, takes account of the reduction of the maximum capacity $C_M$ due to the wear of the trap 5. Secondly, the trap 5 can also store sulphur oxides SOx, as discussed above. Consequently, a proportion of the cells of the trap 5, corresponding to the quantity of sulphur oxides stored $SOx_{ST}$, is temporarily unavailable to interact with the nitrogen oxides NOx until a desulphurisation process is carried out. The residual capacity $C_R$, lastly, represents the cells of the trap 5 that have not captured any molecules and are therefore actually available to interact with molecules of nitrogen oxides NOx.

The quantity of nitrogen oxides stored $NOx_{ST}$ is calculated on the basis of the following equations:

$$NOx_{CAP}=NOx_M K_{TN} K_{CRN} K_{NOx} \quad (4)$$

$$NOx_{CO}=CO_M K_{T1} K_{CO} \quad (5)$$

$$NOx_{HC}=HC_M K_{T1} K_{HC} \quad (6)$$

$$NOx_{ST}=NOx_{OLD}+NOx_{CAP}-NOx_{CO}-NOx_{HC} \quad (7)$$

with the constraint:

$$NOx_{ST} \leq C_D \quad (8)$$

In equations (4), (5), (6) and (7), $NOx_{CAP}$ is the fraction of the upstream quantity of nitrogen oxides $NOx_M$ that is captured by the trap 5 at the current moment, $NOx_{OLD}$ is the quantity of nitrogen oxides stored up to the current moment, and $NOx_{CO}$ and $NOx_{HC}$ represent the fractions of nitrogen oxides present in the trap 5 which, at the current moment, are reacting in a known manner with carbon monoxides and, respectively, non-combusted hydrocarbons, thereby freeing the corresponding cells. Moreover $K_{TN}$ and $K_{T1}$ are coefficients that take account of the temperature dependence of the reaction to capture nitrogen oxides NOx and, respectively, of the reduction reactions of the nitrogen oxides NOx which take place in the trap 5 and are calculated in a known manner on the basis of the temperature signal $V_T$; $K_{CRN}$ is a coefficient of residual capacity that modifies the probability of capture of individual molecules of nitrogen oxides NOx as a function of the residual capacity $C_R$; $K_{NOx}$ is a coefficient of absorption of nitrogen oxides NOx by the trap 5, and $K_{CO}$ and $K_{HC}$ are empirical correction coefficients that are determined experimentally.

The capture efficiency $NOx_{EFF}$ is given by the following equation:

$$NOx_{EFF}=NOx_{CAP}/NOx_M \quad (9)$$

The quantity of sulphur oxides stored $SOx_{ST}$ is calculated by means of a model similar to that illustrated by equations (3) to (6). The following equations in particular apply:

$$SOx_{CAP}=SOx_M K_{TS} K_{CRS} K_{SOx} \quad (10)$$

$$SOx_{CO}=CO_M K_{T2} K_{CO}' \quad (11)$$

$$SOx_{HC}=HC_M K_{T2} K_{HC}' \quad (12)$$

$$SOx_{ST}=SOx_{OLD}+SOx_{CAP}-SOx_{CO}-SOx_{HC} \quad (13)$$

The symbols have the same meaning as the corresponding symbols of equations (4) to (7).

In detail, $SOx_M$ is an upstream quantity of sulphur oxides entering the trap 5 and calculated by multiplying the fuel flow F by an average concentration value of sulphur in petrols, while $SOx_{OLD}$ is the quantity of sulphur oxides stored up to the current moment. In addition, $SOx_{CO}$ and $SOx_{HC}$ represent the fractions of sulphur oxides present in the trap 5 which, at the current moment, are reacting in a known manner with carbon monoxide and, respectively, non-combusted hydrocarbons, thereby freeing the corresponding cells. The coefficients $K_{TS}$ and $K_{T2}$ take account of the temperature dependence of the reaction to capture sulphur oxides SOx and, respectively, of the reduction reactions of the sulphur oxides SOx which take place in the trap 5 and are calculated in a known manner on the basis of the temperature signal $V_T$; $K_{CRS}$ is a coefficient of residual capacity that modifies the probability of capture of a molecule of sulphur oxides SOx as a function of the residual capacity $C_R$; $K_{SOx}$ is a coefficient of absorption of sulphur oxides SOx by the trap 5, and $K_{CO}'$ and $K_{HC}'$ are empirical correction coefficients that are determined experimentally.

Figure 5:
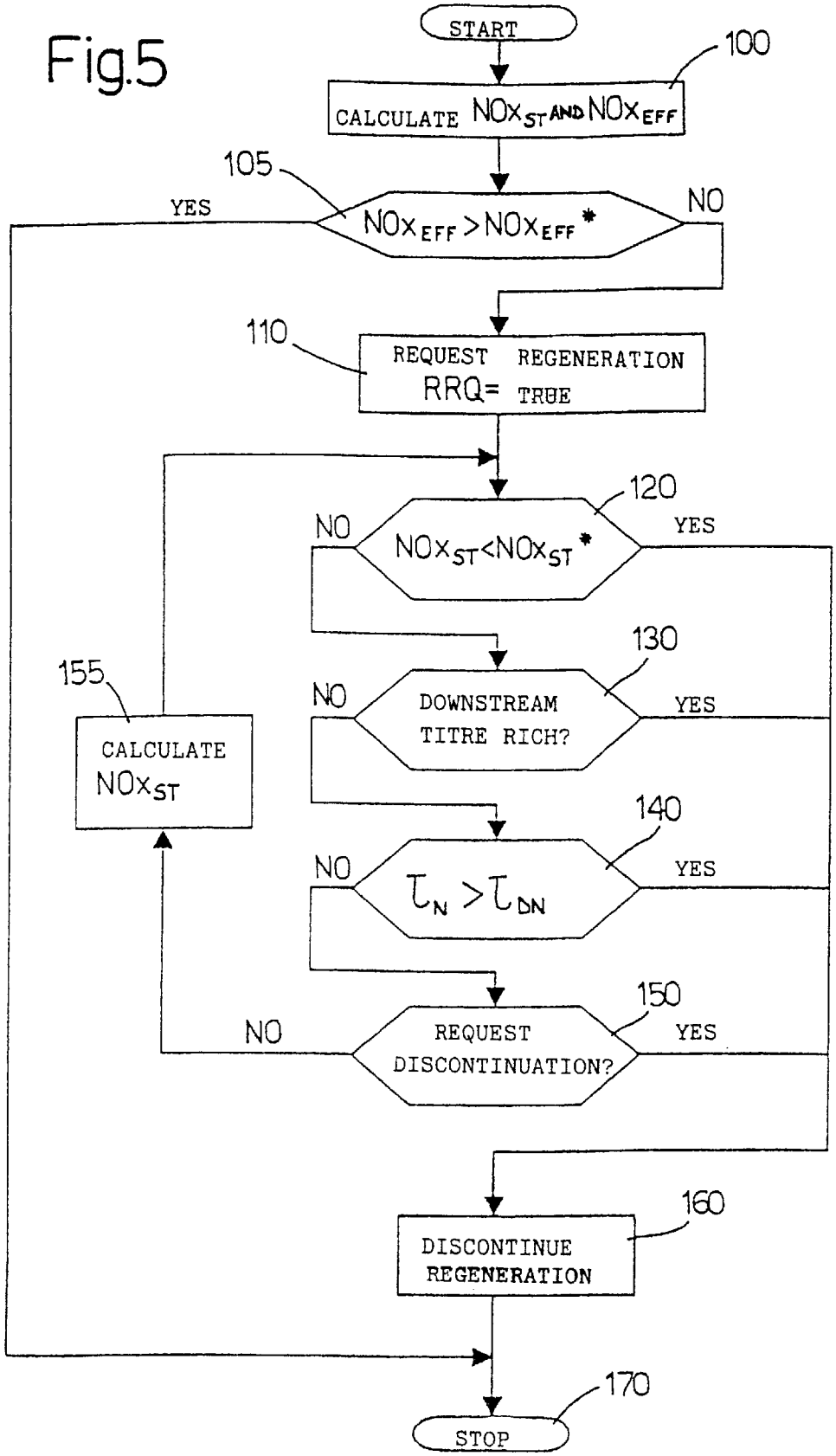

With reference to FIGS. 5 and 6, the regeneration and, respectively, desulphurisation control procedures implemented by the regeneration control block 15 will now be described.

As shown in FIG. 5, at the beginning of the regeneration control procedure, the quantity of nitrogen oxides stored $NOx_{ST}$ and the capture efficiency $NOx_{EFF}$ are calculated according to equations (7) and (9) respectively (block 100).

A test is then carried out to check whether the capture efficiency $NOx_{EFF}$ is greater than a predetermined threshold capture efficiency value $NOx_{EFF}^*$ (block 105). If so, the regeneration control procedure is discontinued (block 170), otherwise a regeneration request is made, in particular by setting the regeneration request signal RRQ to the logic value "TRUE" (block 110). Subsequently, a sequence of four tests is conducted cyclically until at least one of the conditions examined is satisfied. In detail, it is checked whether the quantity of nitrogen oxides stored $NOx_{ST}$ is lower than a threshold quantity of nitrogen oxides stored $NOx_{ST}^*$ (block 120); it is checked whether the value of the downstream titre $\lambda_V$ has fallen significantly below 1, in particular by checking whether a deviation $\Delta$, given by the time integral, for a regeneration time $\tau_N$ that has elapsed from the beginning of regeneration, of a quantity obtained on the basis of a known function of the difference $(1-\lambda_V)$, is greater than a threshold value $\Delta_{TH}$ (block 130); it is therefore checked whether the regeneration time $\tau_N$ is greater than a safety regeneration time $\tau_{DN}$ (block 140) and, lastly, whether a discontinuation of regeneration has been externally requested, for instance by checking whether the regeneration discontinuation signal REND has been set to the logic value "TRUE" (block 150). In all four cases, if the condition examined is verified the regeneration is discontinued (block 160) and the regeneration control procedure is terminated (block 170). If, however, the outcome of the check is negative, after each of the tests relative to the blocks 120, 130 and 140, the subsequent test is carried out, while after the test corresponding to the block 150 the quantity of nitrogen oxides stored $NOx_{ST}$ is calculated again, according to the equation (7) (block 155) and there is therefore a return to the block 120.

Figure 6A:
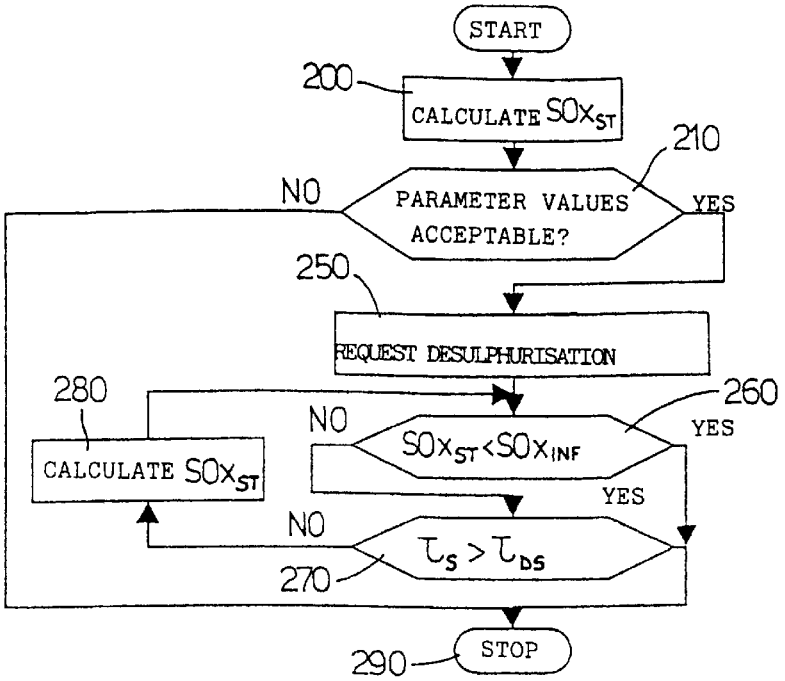

With reference to FIG. 6*a*, the desulphurisation control procedure starts with the calculation of the quantity of sulphur oxides stored $SOx_{ST}$, according to equation (13) (block 200).

A test is then carried out to check whether the conditions for desulphurisation have been met (block 210), as illustrated in detail below. If so, a desulphurisation request is made, setting the desulphurisation request signal DRQ to the logic value "TRUE", (block 250), otherwise the desulphurisation control procedure is concluded (block 290).

Following the desulphurisation request (block 250), a test of the emptying of the trap 5 is carried out to check whether, during desulphurisation, the quantity of sulphur oxides stored $SOx_{ST}$ has fallen below a lower threshold $SOx_{INF}$ (block 260). If so, the desulphurisation control procedure is terminated (block 290), otherwise it is checked whether a desulphurisation time $\tau_S$ that has elapsed since the beginning of desulphurisation is greater than a safety desulphurisation time $\tau_{DS}$ (block 270). If this is the case, the desulphurisation control procedure is concluded (block 290), otherwise the quantity of sulphur oxides stored $SOx_{ST}$ is calculated again in accordance with equation (13) (block 280) and a return is made to carry out the test of the emptying of the trap 5 (block 260).

Figure 6B:
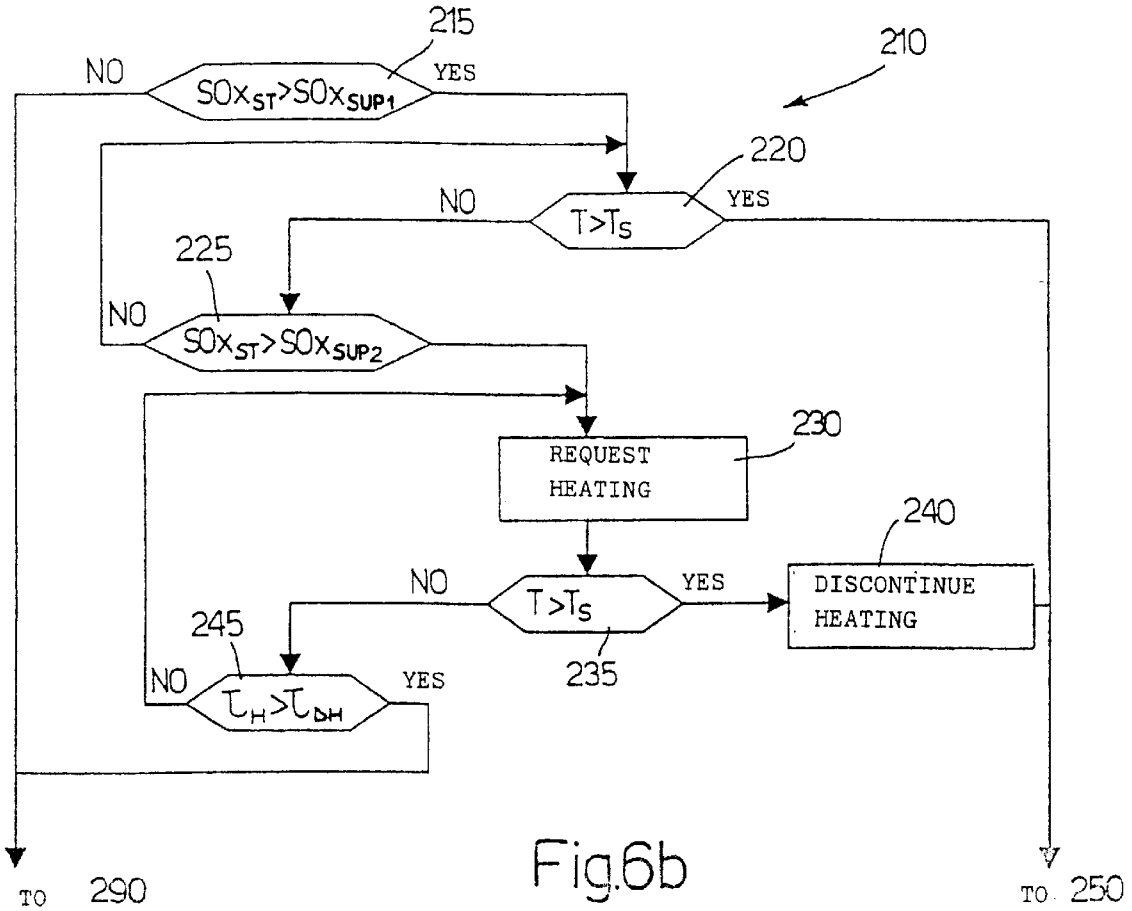

As shown in FIG. 6*b*, checking of the conditions for the conduct of a desulphurisation starts with a test to check whether the quantity of sulphur oxides stored $SOx_{ST}$ is greater than a first upper threshold $SOx_{SUP1}$ (block 215).

If not, the desulphurisation control procedure is concluded (block 290, FIG. 6*a*), otherwise a second test is conducted to check whether the temperature of the exhaust gases T at the input of the trap 5 exceeds a threshold temperature $T_S$ (block 220).

If this is the case, a desulphurisation request is generated (block 250, FIG. 6*a*) and, in the opposite case, the quantity of sulphur oxides stored $SOx_{ST}$ is compared with a second upper threshold $SOx_{SUP2}$ (block 225), greater than the first upper threshold $SOx_{SUP1}$.

If the quantity of sulphur oxides stored $SOx_{ST}$ is greater than the second upper threshold $SOx_{SUP2}$ (output YES from the block 225), heating of the trap 5 is requested, by setting the heating request signal HRQ to the logic value "TRUE" (block 230), otherwise (output NO from the block 225) the test to check the temperature of the exhaust gases T is again carried out (block 220).

Following the heating request (block 230), a new test is carried out to check whether the temperature of the exhaust gases T has exceeded the threshold temperature $T_S$ (block 235).

If this is the case (output YES from the block 235), the heating of the trap 5 is discontinued, by setting the heating request signal HRQ to the logic value "FALSE" (block 240) and the desulphurisation request is generated (block 250, FIG. 6*a*) If, in contrast, the temperature of the exhaust gases T is lower than the threshold temperature $T_S$ (output NO from the block 235), a further test checks whether a heating time $\tau_H$, that has elapsed from the commencement of heating of the trap 5 is greater than a safety heating time $\tau_{DH}$ (block 245).

If so, the desulphurisation procedure is discontinued (block 290, FIG. 6*a*), otherwise the heating request for the trap 5 is confirmed (block 230).

Figure 7:
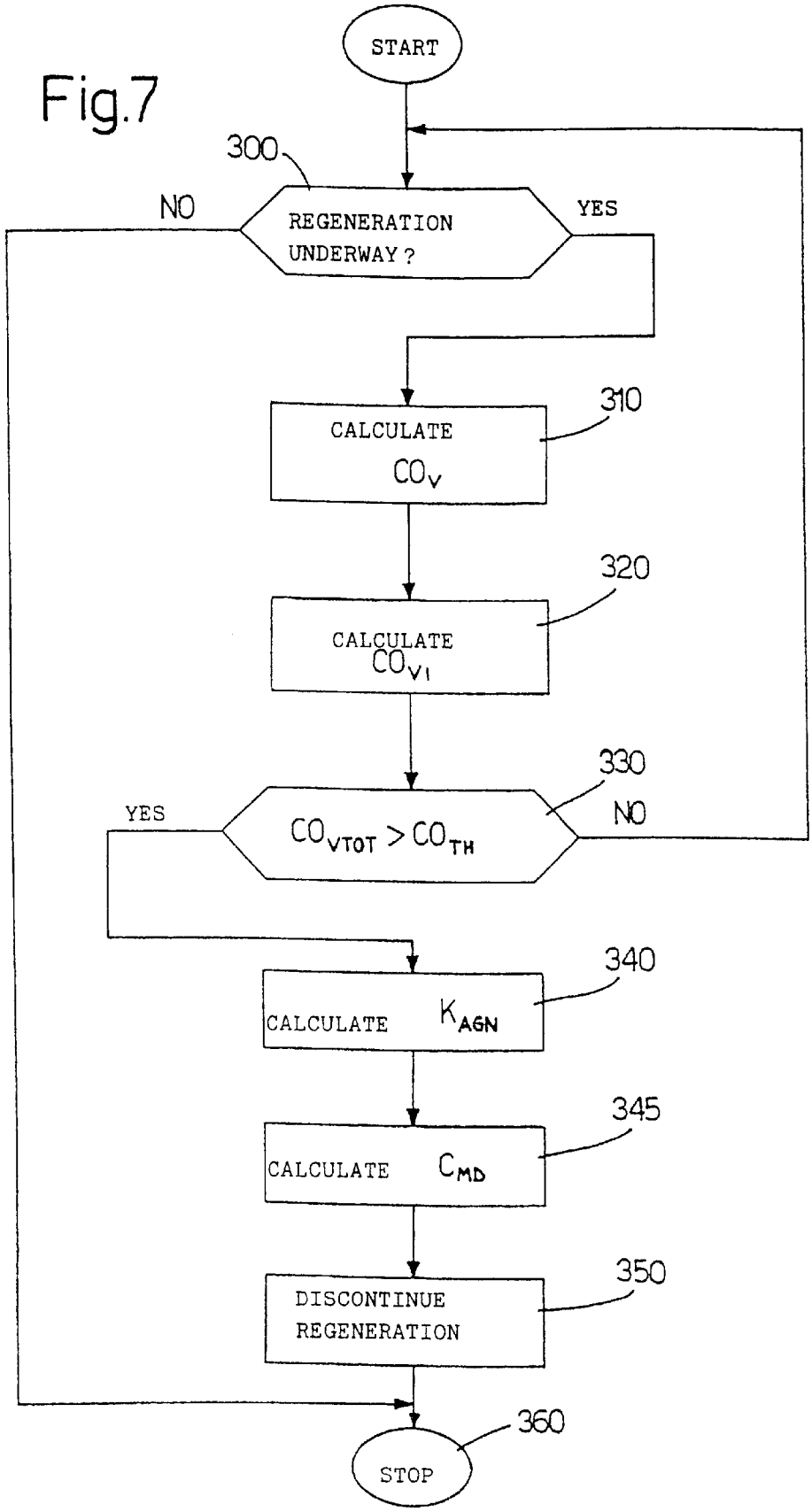

With reference to FIG. 7, the updating algorithm implemented by the parameter estimation block 16 will be described below; during the regeneration stages, this block 16 checks the accuracy of the estimate of the maximum available capacity $C_{MD}$ and, if necessary, updates its value by calculating an updated coefficient of ageing $K_{AGN}$, which is used in equation (1) in place of the coefficient of ageing $K_{AG}$.

Figure 8:
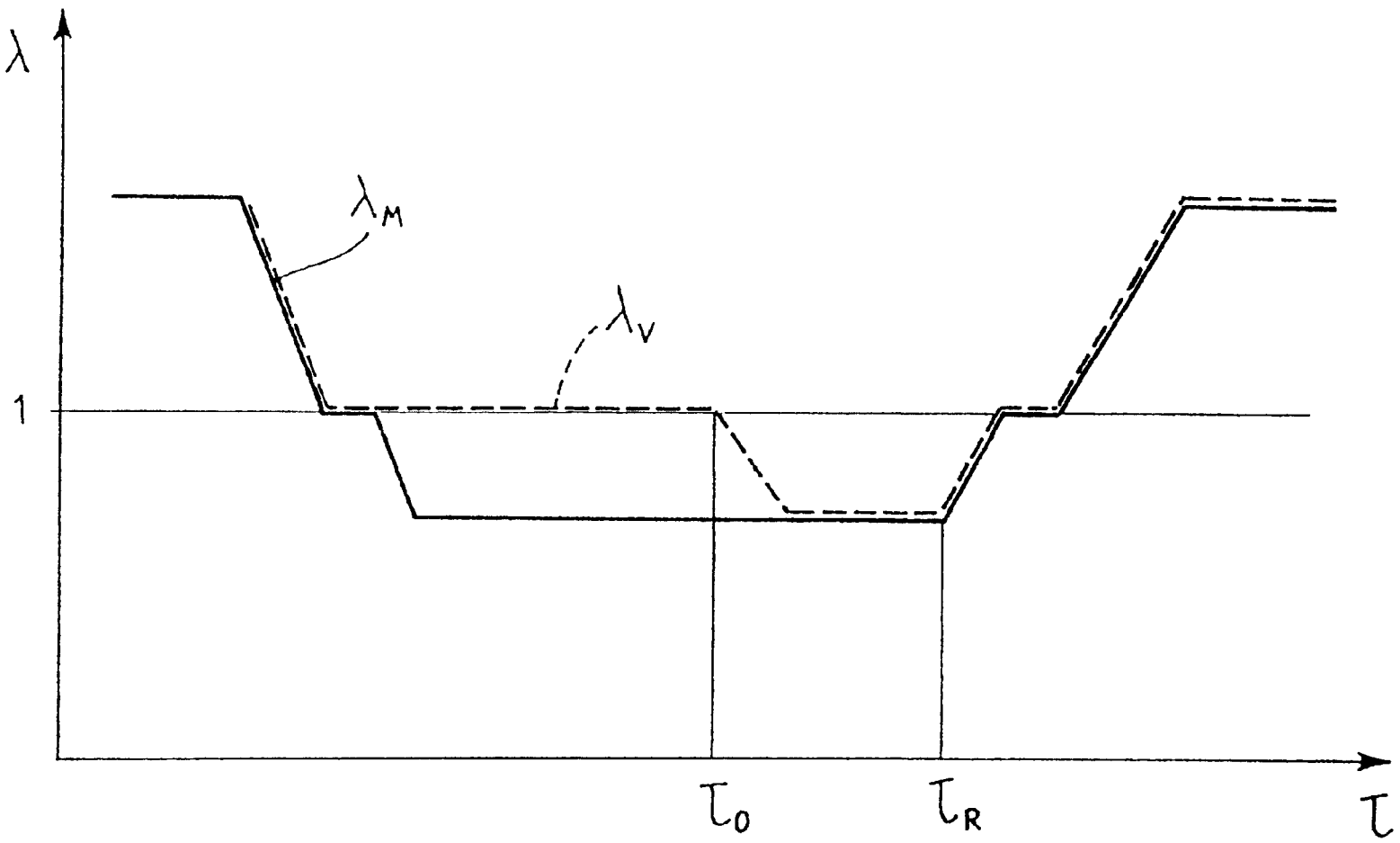
FIG. 8 shows possible curves of the downstream titre of the trap during a process of regeneration in the system of FIG. 2.

In particular, the flow of carbon monoxide downstream $CO_V$ should be zero during the regeneration, since all the carbon monoxide entering the trap 5 reacts with the stored nitrogen oxides NOx, until they are completely eliminated. As a result of the deterioration to which the trap 5 is subject with use, it may nevertheless be the case that the estimate of the maximum available capacity $C_{MD}$ used in the model for the calculation of the quantity of nitrogen oxides stored $NOx_{ST}$ is greater than the actual capacity of the trap 5. In these circumstances, the nitrogen oxides NOx stored in the trap 5 are completely eliminated before the regeneration control block 16 concludes the regeneration process underway. Consequently, the carbon monoxide produced by the engine 2 passes through the trap 5 and gives rise to a flow of carbon monoxide downstream $CO_V$ which is not zero, causing, at the output from the trap 5, the downstream titre $\lambda_V$ to deviate from the stoichiometric value. At a time $\tau_O$ which precedes a regeneration completion instant $\tau_R$ and is indicative of the fact that all the nitrogen oxides NOx stored have been eliminated, the downstream sensor 7 detects a reduction of the downstream titre $\lambda_V$ (reference is made to FIG. 8 in which the downstream titre $\lambda_V$ is shown by a dashed line, and the upstream oxygen titre $\lambda_M$ is shown by a continuous line). On the basis of the downstream composition signal $V_2$ provided by the downstream sensor 7 and a measurement or estimate of the flow of exhaust gases $G_V$, that can be obtained in a known manner, it is possible to ascertain the flow of carbon monoxide downstream $CO_V$ and, by integrating the latter over time, a downstream carbon monoxide mass $CO_{VTOT}$ which represents an index of the error committed in the estimate of the maximum available capacity $C_{MD}$. By comparing the downstream carbon monoxide mass $CO_{VTOT}$ with a threshold mass $CO_{TH}$ it is possible to decide whether it is necessary to adapt the current value of the maximum available capacity $C_{MD}$.

In detail, the updating algorithm starts with a test to check whether a regeneration process is underway, for instance by monitoring whether the regeneration request signal RRQ is set to the logic value "TRUE" and, at the same time, whether the regeneration discontinuation signal REND is set to the logic value "FALSE" (block 300).

If this is not the case, the updating algorithm is terminated (block 360) in the opposite case, the flow of carbon monoxide downstream $CO_V$ is calculated (block 310), according to a known function of the flow of exhaust gases $G_V$ and the downstream titre $\lambda_V$.

The downstream carbon monoxide mass $CO_{VTOT}$ is then calculated by integrating over time the flow of carbon monoxide downstream $CO_V$ (block 320) and compared with the threshold mass $CO_{TH}$ (block 330). If the downstream carbon monoxide mass $CO_{VTOT}$ is lower than the threshold mass $CO_{TH}$ (output NO from the block 330) the test is again carried out to check whether a regeneration process is underway (block 300). If not (output YES from the block 330), the value of the maximum available capacity $C_{MD}$ is corrected by means of an adaptation of the coefficient of ageing $K_{AG}$ (block 340). In particular, the updated coefficient of ageing $K_{AGN}$ is calculated by decreasing the coefficient of ageing $K_{AG}$ by a predetermined value $K_{DEC}$ and then used to calculate an updated value of the maximum available capacity $C_{MD}$ according to the equation:

$$C_{MD}=K_{AGN}\,C_M \tag{1'}$$

The regeneration process is then discontinued, by setting the regeneration discontinuation signal REND to the logic value "TRUE" (block 350) and the parameter updating algorithm is terminated (block 360).

In a second embodiment, which will now be described with reference to FIG. 9, the method is based on a system in which the downstream sensor 5 is formed by a sensor of nitrogen oxides NOx rather than by a sensor of UEGO type. Since the sensor of nitrogen oxides NOx also contains a linear oxygen sensor, it is able to provide as output a signal representative of the concentration of nitrogen oxides NOx and also of the downstream titre $\lambda_V$.

Figure 9:
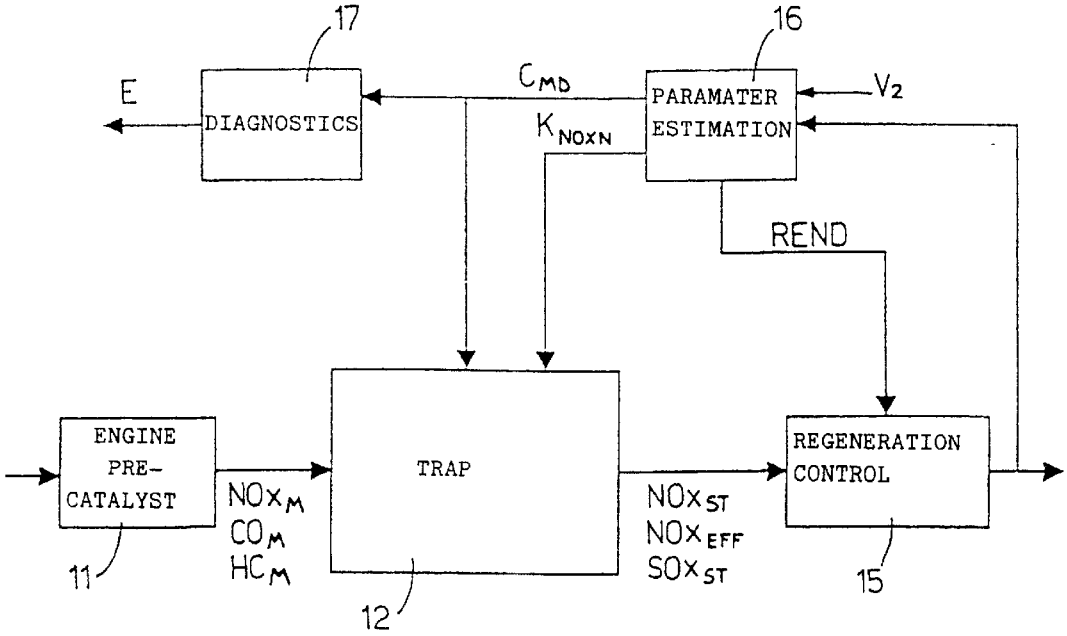
FIG. 9 is a detailed block diagram of a part of a system of the present invention according to a second embodiment.

The simplified block diagram of FIG. 9 shows a control unit 10' similar to the control unit 10, except that a parameter estimation block 16' also supplies as output an updated coefficient of absorption $K_{NOxN}$ which is supplied as input to the trap block 12.

Figure 10:
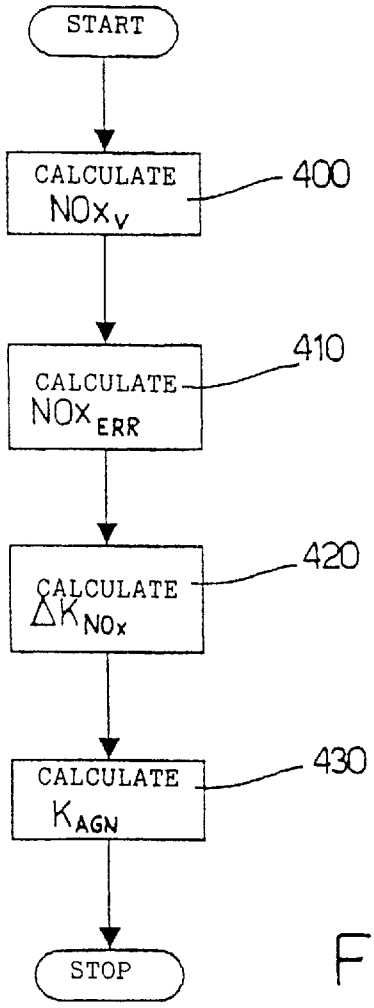
FIG. 10 shows a flow diagram relating to the second embodiment of the control method of the present invention.

With reference to FIG. 10, the parameter estimation block 16' calculates a downstream concentration of nitrogen oxides $NOx_V$ (block 400), as a function of the quantity of nitrogen oxides upstream $NOx_M$ and the quantity of nitrogen oxides exchanged $NOx_{CAP}$ and uses it, together with a measured concentration of nitrogen oxides $NOx_{MIS}$, to calculate an estimation error $NOx_{ERR}$ (block 410) given by the equation:

$$NOx_{ERR}=NOx_V-NOx_{MIS} \quad (14)$$

The estimation error $NOx_{ERR}$ is then used to calculate a correction term $\Delta K_{NOx}$ (block 420) which is added to the coefficient of absorption $K_{NOx}$ to obtain the updated coefficient of absorption $K_{NOxN}$ (block 430).

The proposed method has the following advantages.

Firstly, the possibility of updating the value of the maximum available capacity $C_{MD}$ by using the curve of the downstream composition signal $V_2$ during regeneration makes it possible more accurately to estimate the degree of filling of the trap. Consequently, it is possible precisely to determine the instants of onset of conditions that make it necessary to carry out a regeneration process, irrespective of the state of ageing of the trap 5. This avoids the possibility that, during operation, the trap 5 remains saturated for unacceptable periods and therefore reduces the risk of substantial emissions of nitrogen oxides NOx. Moreover, the duration of the regeneration process may be calculated such that this process is not protracted beyond the moment in which the trap 5 is actually emptied, so as to avoid emissions of non-combusted hydrocarbons HC and carbon monoxide CO, as discussed above, as well as higher consumption.

It is also advantageous, particularly during the performance of the parameter updating algorithm, to use a sensor of UEGO type downstream of the trap 5. This sensor provides an accurate measurement of the exhaust titre, on the basis of which it is possible to determine the quantity of carbon monoxide CO in the exhaust gases and therefore to find out in good time when emptying of the trap 5 has taken place. The information obtained by the UEGO sensor thus makes it possible to provide an efficient criterion for the updating of the maximum available capacity $C_{MD}$.

According to the variant described, a further advantage lies in the use of a sensor of nitrogen oxides NOx. In this case, it is possible to check whether the model used for the calculation of the quantity of nitrogen oxides stored $NOx_{ST}$ and the capture efficiency $NOx_{EFF}$ is correct and, if necessary, to modify it by calculating the updated coefficient of absorption $K_{NOxN}$. Consequently, the estimate of the degree of filling of the trap 5 is more reliable and the probability of polluting emissions is reduced.

It will lastly be appreciated that modifications and variations that do not depart from the scope of protection of the present invention may be made to the method as described.

What is claimed is:

1. A self-adapting control method for an exhaust system for internal combustion engines with controlled ignition, this exhaust system comprising an engine (2), a pre-catalyst (4), means for capturing nitrogen oxides (5) having a maximum initial capacity ($C_M$) and a maximum available capacity ($C_{MD}$) not greater than this maximum initial capacity ($C_M$), oxygen sensor means (7) disposed downstream of the means for capturing nitrogen oxides (5) and generating at least one downstream composition signal ($V_2$) this method comprising the stages of:

a) carrying out at least one process of regeneration of the means for capturing nitrogen oxides (5), b) carrying out at least one process of desulphurisation of the means for capturing nitrogen oxides (5), characterised in that said method further comprises the stage of:

c) estimating, at least after each such process of regeneration of the means for capturing nitrogen oxides (5), the maximum available capacity ($C_{MD}$) as a function of the maximum initial capacity ($C_M$) and the downstream composition signal ($V_2$), and in that the downstream composition signal ($V_2$) is substantially proportional to a downstream oxygen titre ($\lambda_V$).

2. The method as claimed in claim 1, characterised in that the stage c) comprises the stages of:

c1) calculating a flow of carbon monoxide downstream ($CO_V$) as a function of the downstream composition signal ($V_2$) (310);

c2) calculating a downstream carbon monoxide mass ($CO_{VTOT}$) as a function of this flow of carbon monoxide downstream ($CO_V$) (320);

c3) comparing this downstream carbon monoxide mass ($CO_{VTOT}$) with a threshold mass ($CO_{TH}$) (330);

c4) calculating an updated coefficient of ageing ($K_{AGN}$) (340), if this downstream carbon monoxide mass ($CO_{VTOT}$) is greater than the threshold mass ($CO_{TH}$);

c5) calculating a value of the maximum available capacity ($C_{MD}$) (345) according to the equation $$C_{MD}=K_{AGN}C_M.$$

3. The method as claimed in claim 1, characterised in that the stage a) comprises the stages of:

a1) comparing a capture efficiency ($NOx_{EFF}$) with a threshold capture efficiency ($NOx_{EFF}$*) (105);

a2) generating a regeneration request signal (RRQ) (110), if this capture efficiency ($NOx_{EFF}$) is lower than this threshold capture efficiency ($NOx_{EFF}$*);

a3) checking conditions for the discontinuation of regeneration (120, 130, 140, 150).

4. The method as claimed in claim 3, characterised in that the stage a3) comprises the stages of:

a31) comparing a quantity of nitrogen oxides stored ($NOx_{ST}$) with a threshold quantity of nitrogen oxides stored ($NOx_{ST}$*) (120);

a32) calculating a deviation ($\Delta$) as a function of the downstream oxygen titre ($\lambda_V$);

a33) comparing this deviation ($\Delta$) with a threshold deviation ($\Delta_{TH}$);

a34) comparing a regeneration time ($\tau_N$) with a first safety time ($\tau_{DN}$) (140).

5. The method as claimed in claim 4, characterised in that the stage a34) is preceded by the stages of:

a311) calculating a fraction of nitrogen oxides captured ($NOx_{CAP}$);

a312) calculating a first fraction of nitrogen oxides ($NOx_{CO}$) reacting with carbon monoxide;

a313) calculating a second fraction of nitrogen oxides ($NOx_{HC}$) reacting with non-combusted hydrocarbons;

a314) calculating the quantity of nitrogen oxides stored ($NOx_{ST}$) as a function of a current quantity of nitrogen oxides stored ($NOx_{OLD}$), according to the equation:

$$NOx_{ST}=NOx_{OLD}+NOx_{CAP}-NOx_{CO}-NOx_{HC}.$$

6. The method as claimed in claim 5, characterised in that the fraction of nitrogen oxides captured ($NOx_{CAP}$) is calculated as a function of a coefficient of residual capacity ($K_{CRN}$) a first temperature coefficient ($K_{TN}$) and a coefficient of absorption of nitrogen oxides ($K_{NOx}$) according to the equation:

$$NOx_{CAP}=NOx_{M}K_{CRN}K_{TN}K_{NOx}.$$

7. The method as claimed in claim 1, characterised in that the stage b) comprises the stages of:

b1) checking the acceptability conditions of a quantity of sulphur oxides stored ($SOx_{ST}$) and an operating temperature (T) (210);

b2) generating a desulphurisation request signal (DRQ) (250);

b3) checking conditions for the discontinuation of desulphurisation (260, 270).

8. The method as claimed in claim 7, characterised in that the stage b1) is preceded by the stages of:

b01) calculating a fraction of sulphur oxides captured ($SOx_{CAP}$);

b02) calculating a first fraction of sulphur oxides ($SOx_{CO}$) reacting with carbon monoxide;

b03) calculating a second fraction of sulphur oxides ($SOx_{HC}$) reacting with non-combusted hydrocarbons;

b04) calculating the quantity of sulphur oxides stored ($SOx_{ST}$) (200) as a function of a current quantity of sulphur oxides stored ($SOx_{OLD}$), according to the equation:

$$SOx_{ST}=SOx_{OLD}+SOx_{CAP}-SOx_{CO}-SOx_{HC}.$$

9. The method as claimed in claim 8, characterised in that the fraction of sulphur oxides captured ($SOx_{CAP}$) is calculated as a function of a coefficient of residual capacity ($K_{CRS}$), a second temperature coefficient ($K_{TS}$) and a coefficient of absorption of sulphur oxides ($K_{SOx}$), according to the equation:

$$SOx_{CAP}=SOx_{M}K_{CRS}K_{TS}K_{SOx}.$$

10. The method as claimed in claim 7, characterised in that the stage b1) comprises the stages of:

b11) comparing this quantity of sulphur oxides stored ($SOx_{ST}$) with a first upper threshold quantity ($SOx_{SUP1}$) (215);

b12) if this quantity of sulphur oxides stored ($SOx_{ST}$) is greater than this first upper threshold quantity ($SOx_{SUP1}$), checking whether an operating temperature (T) is greater than a threshold temperature ($T_S$) (220);

b13) if this quantity of sulphur oxides stored ($SOx_{ST}$) is lower than this first upper threshold quantity ($SOx_{SUP1}$), discontinuing the desulphurisation process (290).

11. The method as claimed in claim 10, characterised in that the stage b12) is followed by the stages of:

b13) comparing the quantity of sulphur oxides stored ($SOx_{ST}$) with a second upper threshold quantity ($SOx_{SUP2}$) (225);

b14) if this quantity of sulphur oxides stored ($SOx_{ST}$) is greater than this second upper threshold quantity ($SOx_{SUP2}$), generating a heating request (230);

b15) if this quantity of sulphur oxides stored ($SOx_{ST}$) is lower than this second upper threshold quantity ($SOx_{SUP2}$), checking whether this operating temperature (T) is greater than a threshold temperature ($T_S$) (220).

12. The method as claimed in claim 1, characterised in that the stage b14) is followed by the stages of:

b141) comparing this operating temperature (T) with the threshold temperature ($T_S$) (235);

b142) if this operating temperature (T) is higher than this threshold temperature ($T_S$), generating a heating discontinuation request (240);

b143) if this operating temperature (T) is lower than this threshold temperature ($T_S$) comparing a heating time ($\tau_H$) with a second safety time ($\tau_{DH}$) (245);

b144) if this heating time ($\tau_H$) is lower than this second safety time ($\tau_{DH}$), returning to generate a heating request (230);

b145) if this heating time ($\tau_H$) is greater than this second safety time ($\tau_{DH}$), discontinuing the desulphurisation process (290).

13. The method as claimed in claim 12, characterised in that the stage b14) comprises the stage of assigning a first logic value ("TRUE") to a heating request signal (HRQ) and in that the stage b142) comprises the stage of assigning a second logic value ("FALSE") to this heating request signal (HRQ).

14. The method as claimed in claim 7, characterised in that the stage b3) comprises the stages of:

b31) comparing the quantity of sulphur oxides stored ($SOx_{ST}$) with a lower threshold quantity ($SOx_{INF}$) (260);

b32) comparing a desulphurisation time ($\tau_S$) with a third safety time ($\tau_{DS}$) (270);

b33) calculating this quantity of sulphur oxides stored ($SOx_{ST}$) (275) according to the equation:

$$SOx_{ST}=SOx_{OLD}+SOx_{CAP}-SOx_{CO}-SOx_{HC}$$

if the quantity of sulphur oxides stored ($SOx_{ST}$) is greater than this lower threshold quantity ($SOx_{INF}$) and if the desulphurisation time ($\tau_S$) is lower than the third safety time ($\tau_{DS}$).

15. The method as claimed in claim 1, characterised in that it further comprises the stages of:

d) comparing the maximum available capacity ($C_{MD}$) with a threshold capacity ($C_{TH}$) (50);

e) generating an error signal (E) (60) if this maximum available capacity ($C_{MD}$) is lower than this threshold capacity ($C_{TH}$).

16. The method as claimed in claim 1, characterised in that the oxygen sensor means (7) comprise a sensor of linear LAMBDA type.

17. The method as claimed in claim 1, characterised in that the oxygen sensor means (7) comprise a sensor of nitrogen oxides.

18. The method as claimed in claim 17, characterised in that it further comprises the stage of:

f) calculating an updated coefficient of absorption ($K_{NOxN}$) as a function of an estimation error ($NOx_{ERR}$) (430).

19. The method as claimed in claim 18, characterised in that the stage f) is preceded by the stages of:

f1) calculating a concentration of nitrogen oxides downstream ($NOx_V$) as a function of a concentration of nitrogen oxides upstream ($NOx_M$) and of the fraction of nitrogen oxides captured ($NOx_{CAP}$);

f2) calculating this estimation error ($NOx_{ERR}$) as a function of this concentration of nitrogen oxides downstream ($NOx_V$) and of the measured concentration ($NOx_{MIS}$), according to the equation:

$$NOx_{ERR}=NOx_V-NOx_{MIS}.$$

* * * * *